US008531264B2

(12) United States Patent
Li et al.

(10) Patent No.: US 8,531,264 B2
(45) Date of Patent: Sep. 10, 2013

(54) CURRENT SENSING RESISTOR AND METHOD FOR MANUFACTURING THE SAME

(75) Inventors: Chun-Yen Li, Taoyuan (TW); Yi-Kun Chiu, Taoyuan (TW); Ching-Chen Hu, Taoyuan (TW)

(73) Assignee: TA-I Technology Co., Ltd., Taoyuan (TW)

( * ) Notice: Subject to any disclaimer, the term of this patent is extended or adjusted under 35 U.S.C. 154(b) by 0 days.

(21) Appl. No.: 13/342,335

(22) Filed: Jan. 3, 2012

(65) Prior Publication Data

US 2013/0120104 A1 May 16, 2013

(30) Foreign Application Priority Data

Nov. 15, 2011 (TW) ..... 100141692 A

(51) Int. Cl.
*H01C 7/00* (2006.01)

(52) U.S. Cl.
USPC ..... 338/333; 338/195; 338/322

(58) Field of Classification Search
USPC ..... 338/333, 322, 195
See application file for complete search history.

(56) References Cited

U.S. PATENT DOCUMENTS

| | | | | |
|---|---|---|---|---|
| 5,287,083 | A * | 2/1994 | Person et al. | 338/332 |
| 5,999,085 | A | 12/1999 | Szware et al. | |
| 7,042,328 | B2 * | 5/2006 | Schneekloth et al. | 338/59 |
| RE39,660 | E * | 5/2007 | Szwarc et al. | 338/309 |
| 8,183,976 | B2 * | 5/2012 | Lo et al. | 338/314 |
| 8,319,598 | B2 * | 11/2012 | Zandman et al. | 338/195 |
| 2011/0063072 | A1 * | 3/2011 | Lo et al. | 338/314 |

* cited by examiner

*Primary Examiner* — Kyung Lee
(74) *Attorney, Agent, or Firm* — WPAT, P.C.; Anthony King

(57) ABSTRACT

The present invention relates to a current sensing resistor made by an electrically conductive metal plate, and the current sensing resistor comprising: a middle portion; a first portion with a first slot located at one side of the middle portion; and a second portion with a second slot located at the other side of the middle portion opposite to the first portion; wherein each of the first and second portions is divided into a current terminal and a sensing terminal by the first and second slots respectively, and the current terminals of the first and second portions have a length greater than that of the sensing terminals of the first and second portions; characterized in that the middle portion has a middle slot and the length of the middle slot can be used for controlling the stability of resistance for the current sensing resistor.

11 Claims, 5 Drawing Sheets

CURRENT SENSING RESISTOR AND METHOD FOR MANUFACTURING THE SAME

BACKGROUND OF THE INVENTION

1. Field of the Invention

The present invention relates to a resistor, and more particularly, to a current sensing resistor.

2. Description of the Prior Art

Current sensing resistors have been used in the electronic industry for many years, and are formed on the basis of the Kelvin theory or the 4-wire theory. The current sensing resistor is mainly used for application of low resistance, and has the advantages of low temperature coefficient and high heat dissipation performance when compared with general resistors. A conventional current sensing resistor (such as the U.S. Pat. No. 5,999,085) adopts a structure where a metal plate with fixed resistance is a middle portion and each of the two opposite terminals of the plate is fixedly connected to a side portion with high electrical conductivity. Each of the pair of side portions has a slot, dividing each of the pair of side portions into a current terminal and a sensing terminal. The length of the slot may be used for deciding the stability of resistance of the current sensing resistor.

The conventional current sensing resistor is formed through the fixed connection of different materials of metal or alloy, which is time-consuming during manufacturing and is also difficult to control the material characteristics of the metal or alloy. Moreover, other methods such as soldering or adhering are inevitably used during the fixed connection process, and the use of extra materials renders that the conventional current sensing resistor is incapable of fully demonstrating the material characteristics of a resistor substrate. As a result, the stability of resistance of the current sensing resistor is affected.

Therefore, a current sensing resistor made through an integral molding method is required in the market, allowing such current sensing resistor to be formed by only one material of metal or alloy. Therefore, the characteristics of the metal or alloy may be fully demonstrated, and it will also be easier to select the corresponding metal or alloy according to the required resistor characteristics. In this manner, manufacturing is more convenient, and the stability of resistance of the current sensing resistor is further improved.

SUMMARY OF THE INVENTION

In order to achieve the above objectives and efficacies, the present invention adopts an innovative technical means and an innovative method.

An embodiment of the present invention provides a current sensing resistor, which is made by a highly electrically conductive metal plate, and the metal plate includes: a middle portion; a first portion, located at one side of the middle portion, having a first slot; and a second portion, located at the other side of the middle portion opposite to the first portion, having a second slot; where each of the first portion and the second portion is divided into a current terminal and a sensing terminal by the first slot and the second slot respectively, and the current terminals of the first portion and the second portion have a length that is greater than that of the sensing terminals of the first portion and the second portion; characterized in that the middle portion has a middle slot and the length of the middle slot can be used for controlling the stability of resistance for the current sensing resistor.

Another embodiment of the present invention provides a method for manufacturing a current sensing resistor, which includes: forming at least one resistor substrates on a highly electrically conductive metal plate through stamping, where the resistor substrate has a middle slot at a middle portion and has a slot at each of the two side portions of the middle portion; forming a passivation layer at the middle portion of the resistor substrate; and forming a conductive layer at the two side portions of the resistor substrate.

In order to make the aforementioned objectives, features and advantages of the present invention more comprehensible, exemplary embodiments with accompanying drawings are described in detail below.

DETAILED DESCRIPTION

Figure 1:
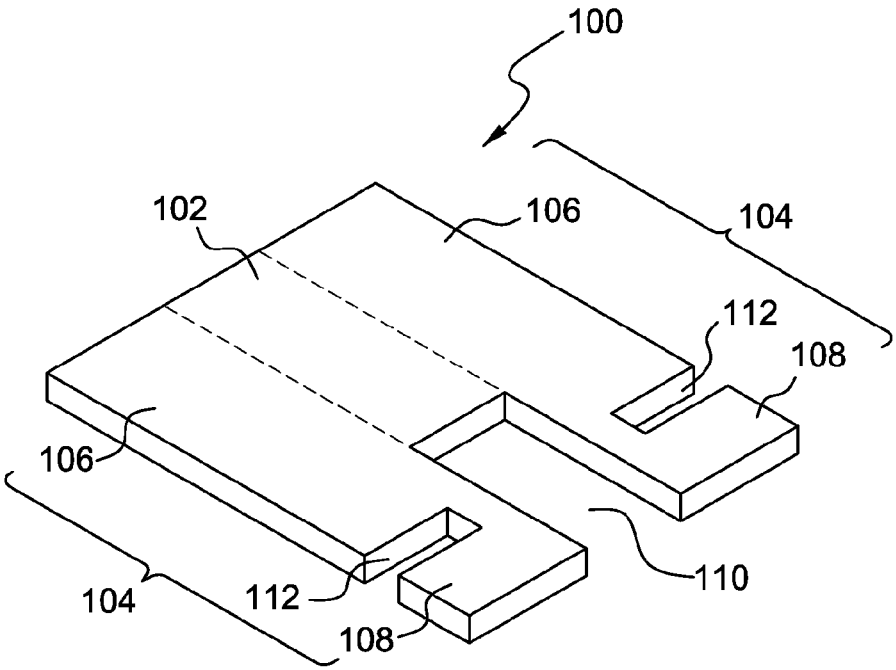
FIG. 1 shows the structure of a current sensing resistor according to an embodiment of the present invention.

FIG. 1 shows an embodiment of the present invention, which is a current sensing resistor 100 made by a highly electrically conductive metal plate, and the current sensing resistor 100 may be divided into two portions, namely a middle portion 102 and a pair of side portions 104, where the pair of side portions 104 are respectively located at two opposite sides of the middle portion 102. In an embodiment of the present invention, the side portions may be a first portion and a second portion, which are generally referred to as the side portions 104 herein. Each of the side portions 104 has a slot 112, and each of the side portions 104 may be divided into a current terminal 106 and a sensing terminal 108 by the slot 112. The middle portion of the current sensing resistor 100 includes a middle slot 110, and the depth of the middle slot 110 is used for deciding the stability of resistance of the current sensing resistor 100.

Current flowing through the current sensing resistor 100 mainly passes through the current terminal 106. Therefore, the length of the current terminal 106 should be greater than that of the sensing terminal 108, and the length of the current terminal 106 is selected according to the magnitude of the current.

In an embodiment, the current terminal 106 and the sensing terminal 108 of the pair of side portions 104 may include a conductive layer (not shown), so that four terminals of the current sensing resistor 100 may be connected to an external circuit. In a preferable embodiment, the material of the conductive layer may include Cu, Ni or Sn.

In an embodiment, the material of the metal plate may have a low resistance coefficient and a low resistance-temperature coefficient. The material of the metal plate may be selected according to the characteristics (such as the resistance coefficient or the resistance-temperature coefficient) of the desired current sensing resistor 100. In a preferable embodiment, the material of the metal plate may include Cu—Mn alloy, Ni—Cu alloy or Mn—Cu—Sn alloy.

In another embodiment, the middle portion 102 may be covered with a passivation layer (not shown), for protecting a resistor body portion of the current sensing resistor 100. In a preferable embodiment, materials such as either resin or a high polymer material may be used for the passivation layer. As shown in FIG. 1, in a preferable embodiment, the length (or depth) of the middle slot 110 is greater than or equal to the length of the slot 112 plus the length of the sensing terminal 108.

Figure 2:
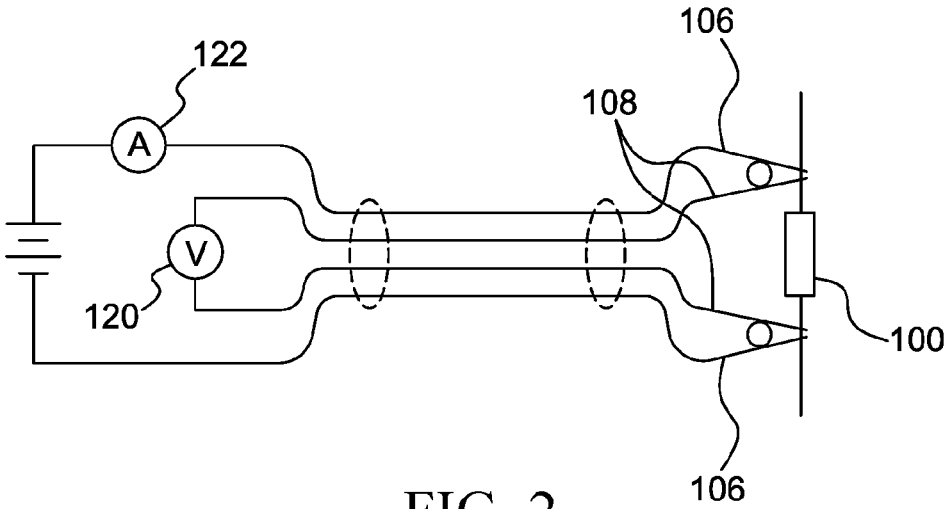
FIG. 2 is an equivalent diagram of a current sensing resistor of FIG. 1.

FIG. 2 is an equivalent diagram of the current sensing resistor 100. As shown in FIG. 2, when the resistance of the current sensing resistor 100 is measured, the current terminal 106 needs to be connected to an ammeter 122, and the sensing terminal 108 needs to be connected to a voltmeter 120. The voltage of the voltmeter 120 is divided by the current of the ammeter 122 according to the Ohm's law, to obtain the resistance of the current sensing resistor 100.

Figure 3A:
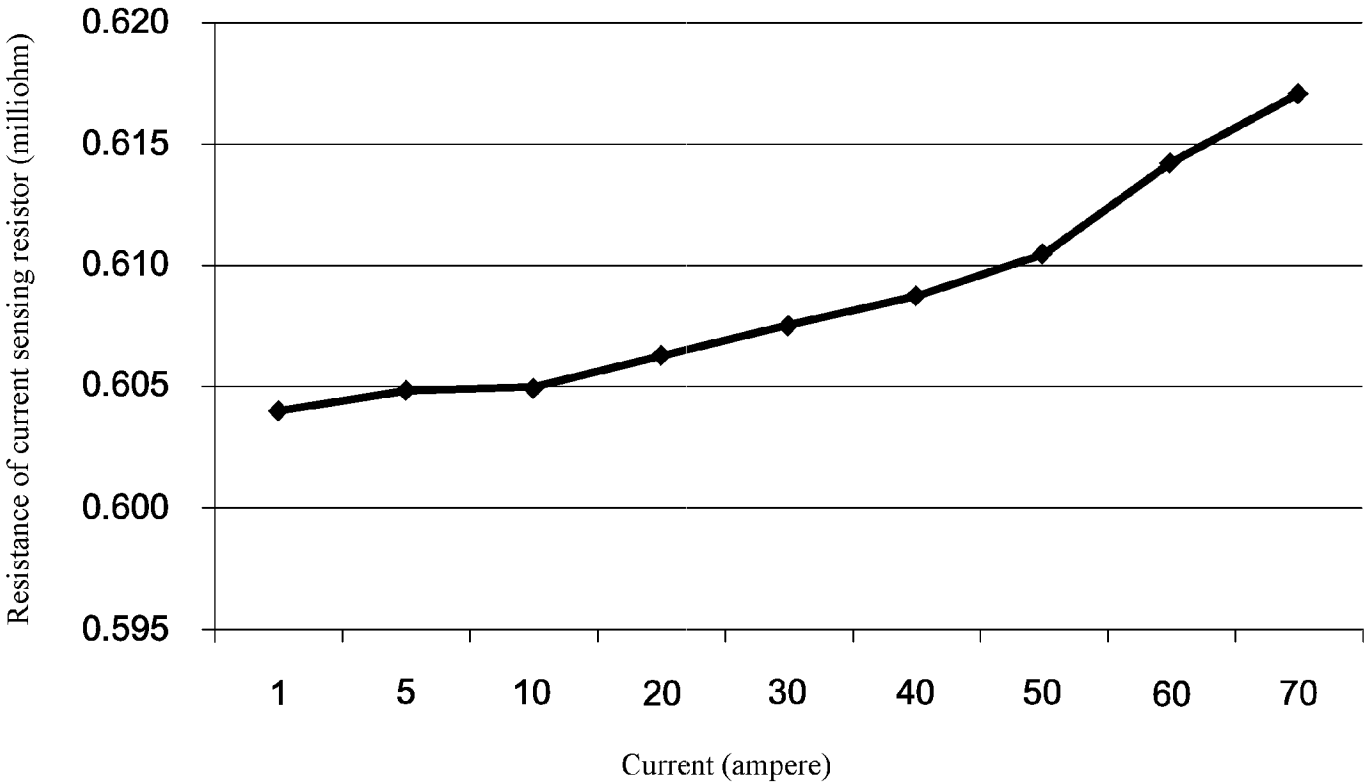
FIG. 3*a* is a diagram of a relationship between the magnitude of current flowing through a current sensing resistor and the magnitude of resistance of the current sensing resistor according to an embodiment of the present invention.
Figure 3B:
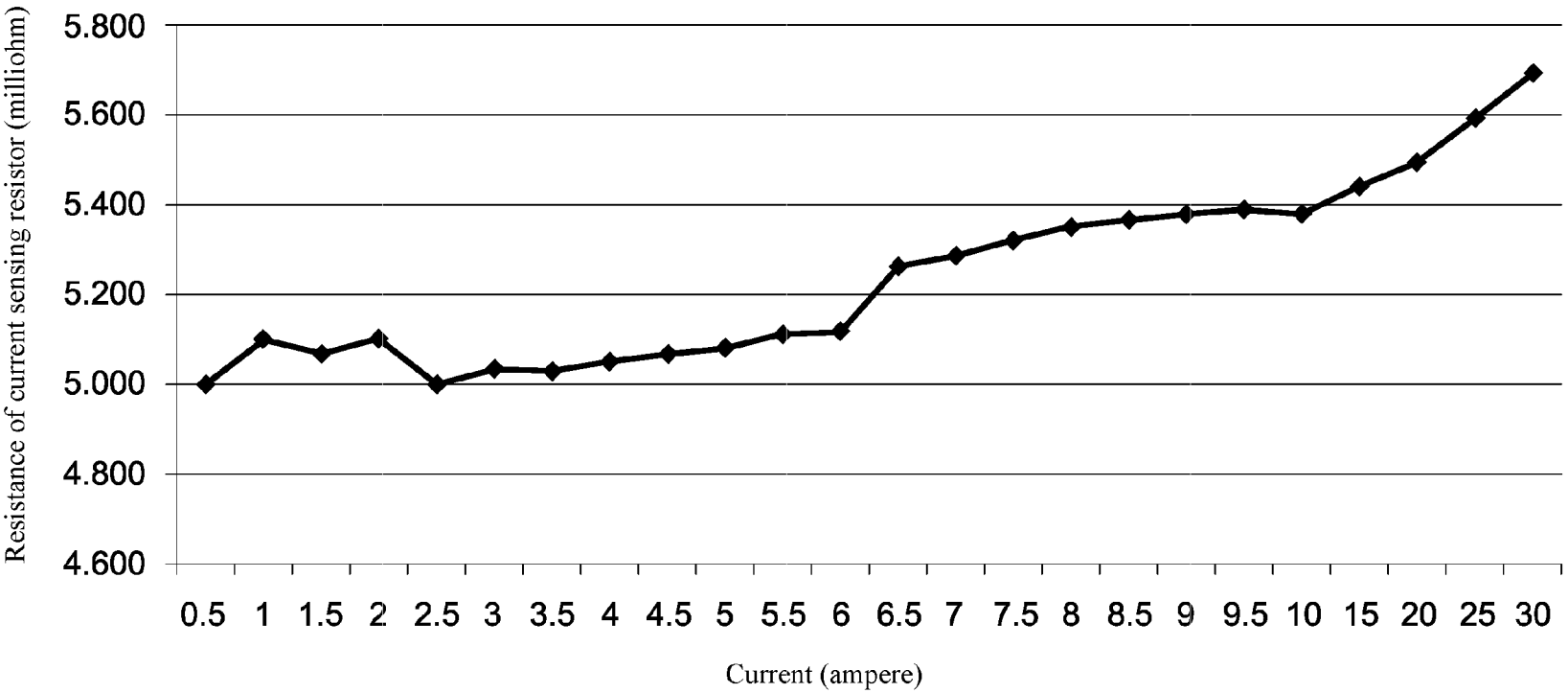
FIG. 3*b* is a diagram of a relationship between the magnitude of current flowing through a conventional current sensing resistor and the magnitude of resistance of the conventional current sensing resistor.

FIG. 3*a* is a measurement result according to an embodiment of the present invention, and a relationship between the resistance of the current sensing resistor 100 and the current passing through the current sensing resistor 100 is measured. An abscissa represents the current, and a unit thereof is ampere; an ordinate represents the magnitude of resistance of the current sensing resistor 100, and a unit thereof is milliohm. In the present invention, when the current passing through the current sensing resistor 100 is increased from 1 ampere to 30 amperes, the resistance of the current sensing resistor 100 is changed only by 0.004 milliohm. FIG. 3*b* is a measurement result of a conventional current sensing resistor. When the current passing through the conventional current sensing resistor is increased from 1 ampere to 30 amperes, the resistance of the conventional current sensing resistor is changed by 0.6 milliohm. Therefore, it can be known that, with the same amount of current change (30 amperes), the resistance change of the current sensing resistor 100 of the present invention is much smaller than that of the conventional current sensing resistor.

Figure 3C:
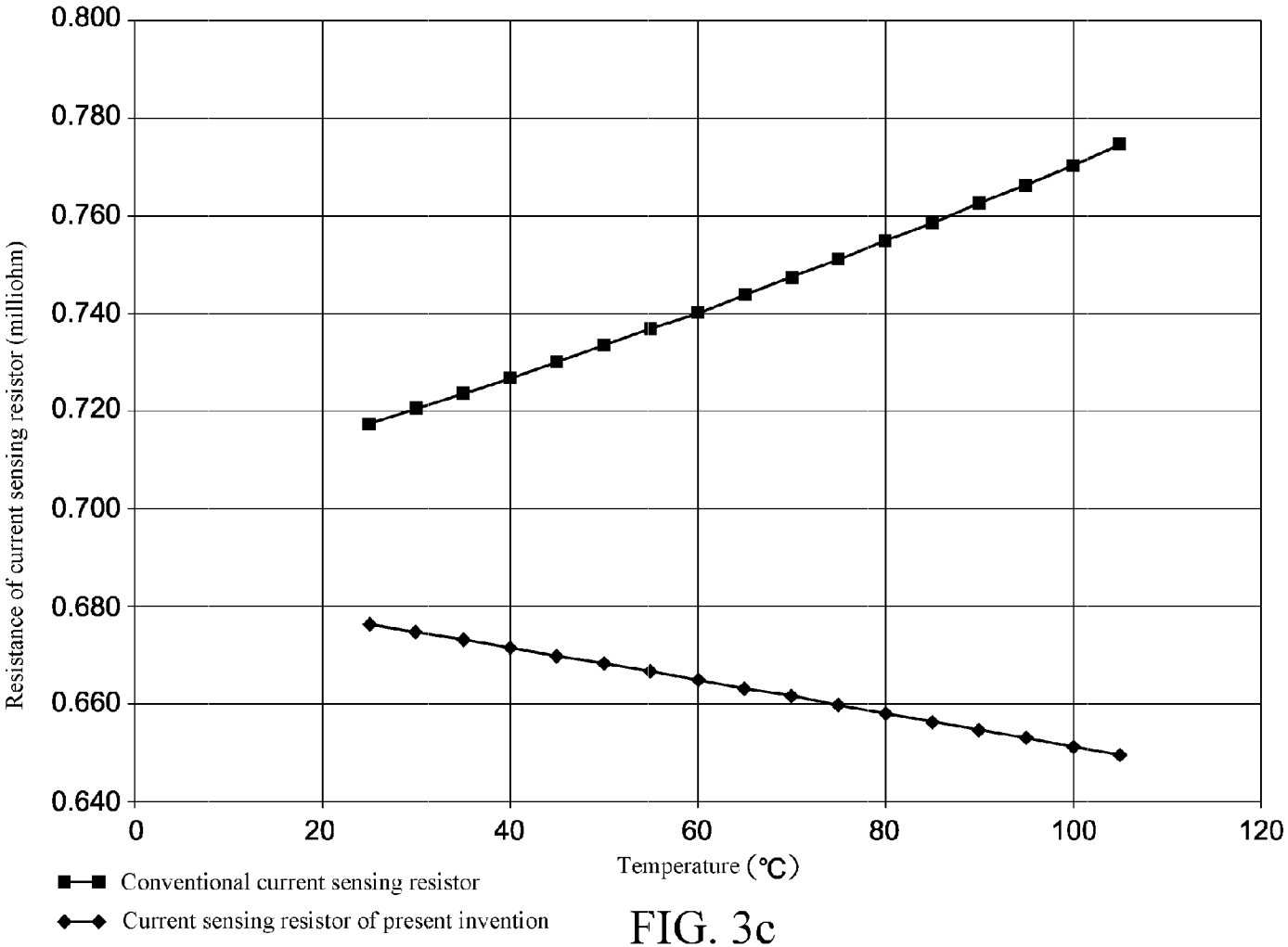
FIG. 3*c* is a diagram of a relationship between the temperature and the magnitude of resistance of a current sensing resistor according to an embodiment of the present invention.

In addition, FIG. 3*c* is another measurement result according to an embodiment of the present invention, which shows a relationship between the temperature and the magnitude of resistance of the current sensing resistor 100 under a fixed current (30 amperes in this embodiment). An abscissa represents the temperature, and a unit thereof is degree Celsius; an ordinate represents the magnitude of resistance of the current sensing resistor 100, and a unit thereof is milliohm. In addition to showing the measurement result of an embodiment of the present invention, FIG. 3*c* also includes a measurement result of the conventional current sensing resistor for comparison. It can be known from FIG. 3*c* that, when an operating temperature of the conventional current sensing resistor is increased from 20 degrees Celsius to 100 degrees Celsius, the resistance thereof is increased by 0.06 milliohm. When the operating temperature of the current sensing resistor 100 of the present invention is increased from 20 degrees Celsius to 100 degrees Celsius, the resistance thereof is decreased by 0.025 milliohm.

Referring to FIGS. 3*a* to 3*c*, when compared with the conventional current sensing resistor, the current sensing resistor 100 of the present invention has a smaller resistance change when the current changes. In addition, the current sensing resistor 100 of the present invention also has a lower temperature coefficient. The lower temperature coefficient may resist a resistance measurement offset caused by a temperature rise due to a high-voltage pulse or high-temperature environment. Therefore, the current sensing resistor 100 of the present invention is more stable.

Figure 4:
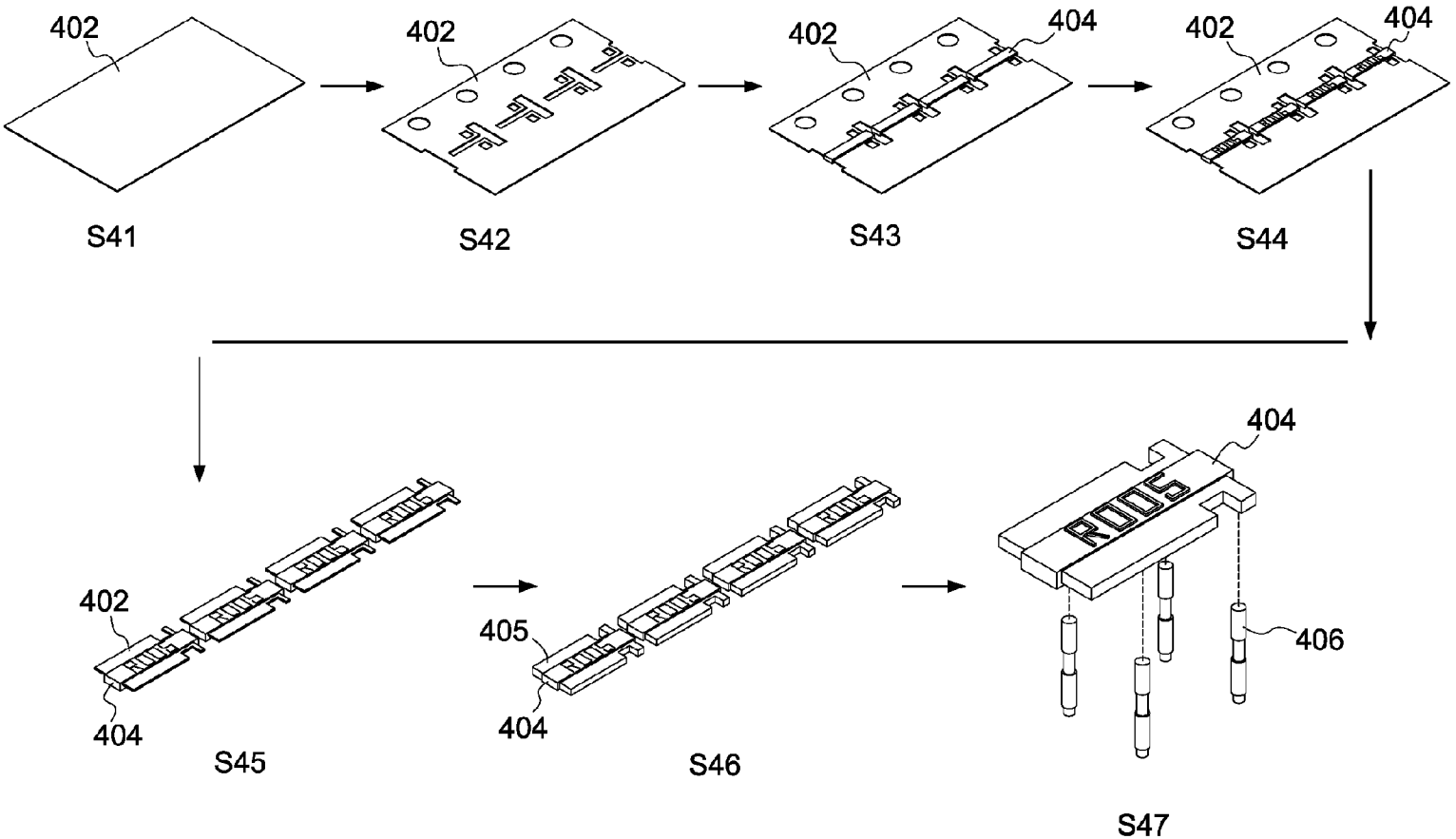
FIG. 4 shows a method for manufacturing a current sensing resistor according to an embodiment of the present invention.

FIG. 4 shows a method for manufacturing a current sensing resistor according to the present invention. In Step S41, the material of a highly electrically conductive metal plate 402 is selected according to the desired resistance characteristics (such as the resistance coefficient or resistance-temperature coefficient) of a resistor. In Step S42, at least one resistor substrate is formed on the highly electrically conductive metal plate 402 through stamping or cutting. In Step S43, a passivation layer 404 is formed at a middle portion of the resistor substrate, where materials such as either resin or a high polymer material may be used for the passivation layer. In Step S45, the resistor substrates are divided into separate resistors through punching or cutting. In Step S46, a conductive layer 405 is respectively formed at the two side portions of each resistor substrate.

In another embodiment, electrodes of the resistor may be connected to an external conductive element 406 in Step S46 of the method, such that the resistance of the current sensing resistor may be measured and/or the stability of resistance may be adjusted by controlling the length of a middle slot.

According to an embodiment of the present invention, the material of the metal plate 402 may include Cu—Mn alloy, Ni—Cu alloy or Mn—Cu—Sn alloy, and the conductive layer may be formed by plating Cu, Ni or Sn.

In another embodiment, in Step S44 of the method, a trademark, a resistance or a related pattern is marked on the passivation layer.

In another embodiment, Step S45 and Step S46 of the method may be interchanged, if required, and the above steps merely demonstrate one of the embodiments.

The technical content and features of the present invention have been described; however, persons of ordinary skill in the technical field of the present invention can still make variations and modifications without departing from the teachings and disclosure of the present invention. Therefore, the disclosed embodiments are not intended to limit the present invention. Modifications and variations made without departing from the present invention shall fall within the scope of the present invention as specified in the following claims.

LIST OF REFERENCE NUMERALS

100 Current sensing resistor
102 Middle portion
104 Side portion
106 Current terminal
108 Sensing terminal
110 Middle slot
112 Slot
120 Voltmeter
122 Ammeter
402 Metal plate
404 Passivation layer
405 Conductive layer
406 Conductive element

What is claimed is:

1. A current sensing resistor made by a highly electrically conductive metal plate, the metal plate comprising:

a middle portion;

a first portion, located at one side of the middle portion and having a first slot; and a second portion, located at the other side of the middle portion opposite to the first portion and having a second slot, wherein each of the first portion and the second portion is divided into a current terminal and a sensing terminal by the first slot and the second slot respectively, and the current terminals of the first portion and the second portion have a length that is respectively greater than that of the sensing terminals of the first portion and the second portion, characterized in that the middle portion has a middle slot, and the length of the middle slot is used for controlling the stability of resistance for the current sensing resistor, and in that the length of the middle slot is greater than or equal to the length of the first or second slot plus the length of the sensing terminal of the first or second portion.

2. The resistor according to claim 1, wherein the material of the metal plate has a low resistance coefficient and a low resistance-temperature coefficient.

3. The resistor according to claim 1, wherein the material of the metal plate comprises Mn—Cu alloy, Ni—Cu alloy or Mn—Cu—Sn alloy.

4. The resistor according to claim 1, wherein the lengths of the current terminal of the first portion and the second portion are decided according to the magnitude of current flowing through the resistor.

5. The resistor according to claim 1, wherein the middle portion comprises a passivation layer of resin or a high polymer material thereon.

6. The resistor according to claim 1, wherein each of the first portion and the second portion comprises a conductive layer of Cu, Ni or Sn thereon.

7. A method for manufacturing a current sensing resistor, comprising:

forming at least one resistor substrate on a highly electrically conductive metal plate through stamping or cutting, wherein the resistor substrate has a middle slot at a middle portion and has a slot respectively at two side portions of the middle portion, wherein each of the two side portions is divided into a current terminal and a sensing terminal by the slot, and wherein the length of the middle slot is greater than or equal to the length of the slot plus the length of the sensing terminal;

forming a passivation layer at the middle portion of the resistor substrate; and respectively forming a conductive layer at the two side portions of the middle portion of the resistor substrate.

8. The method according to claim 7, further comprising: dividing the resistor substrates into separate resistors through punching or cutting.

9. The method according to claim 7, further comprising: adjusting the stability of resistance of the resistor by controlling the length of the middle slot.

10. The method according to claim 7, wherein the passivation layer is formed by resin or a high polymer material.

11. The method according to claim 7, wherein the conductive layer is formed by plating Cu, Ni or Sn.

* * * * *